United States Patent [19]

Nishimoto

[11] 4,195,545

[45] Apr. 1, 1980

[54] DIGITAL TOUCH RESPONSE CIRCUIT OF ELECTRONIC MUSICAL INSTRUMENT

[75] Inventor: Tetsuo Nishimoto, Hamamatsu, Japan

[73] Assignee: Nippon Gakki Seizo Kabushiki Kaisha, Hamamatsu, Japan

[21] Appl. No.: 878,481

[22] Filed: Feb. 16, 1978

[30] Foreign Application Priority Data

Feb. 18, 1977 [JP] Japan ..... 52-16828

[51] Int. Cl.[2] ..... G10H 1/02

[52] U.S. Cl. ..... 84/1.26; 84/1.27; 84/1.13; 84/1.24

[58] Field of Search ..... 84/1.01, 1.03, 1.13, 84/1.24, 1.26, 1.27, DIG. 7, DIG. 8, DIG. 23

[56] References Cited

U.S. PATENT DOCUMENTS

| | | | |
|---|---|---|---|
| 3,626,074 | 12/1971 | Hiyama | 84/1.13 |
| 3,819,843 | 6/1974 | Okamoto | 84/1.27 |
| 4,033,219 | 7/1977 | Deutsch | 84/1.13 |
| 4,067,253 | 1/1978 | Wheelwright | 84/1.13 |
| 4,119,006 | 10/1978 | Whitefield | 84/1.13 |

*Primary Examiner*—J. V. Truhe
*Assistant Examiner*—William L. Feeney
*Attorney, Agent, or Firm*—Frishauf, Holtz, Goodman and Woodward

[57] ABSTRACT

In a digital touch response circuit or touch signal processing circuit for producing a control waveform signal to control a musical tone to be produced in response to a player's finger touch on a key, digital touch data representing a player's instantaneous finger touch on a key is compared in a comparison circuit with digital output data from an operation circuit such as an adder circuit, which varies at a rate as the result of addition of a rate value to input data applied to the adder. A selection circuit is responsive to the comparison circuit to selectively couple the output data of the adder and the digital touch data to a temporary memory circuit such as shift registers. The output data from the memory circuit is coupled to the adder as the input data thereto. When the pressure applied to the key is increasing (crescendo) the digital touch data is fed to the memory through the selection circuit, and, when the pressure applied to the key is decreasing (diminuendo) at a rate larger than the rate at which the output data of adder varies, the output data of the adder is coupled to the memory circuit via the selection circuit to thereby obtain a decaying control waveform signal. The output data of the memory is utilized to form the control envelope.

12 Claims, 6 Drawing Figures

DIGITAL TOUCH RESPONSE CIRCUIT OF ELECTRONIC MUSICAL INSTRUMENT

BACKGROUND OF THE INVENTION

The present invention relates to an electronic musical instrument capable of controlling a musical tone in response to a player's finger touch on a key and, more particularly, to a finger touch response circuit to control the musical tone.

It is desirable that an electronic musical instrument have a function to control at least one of a pitch, tone color and volume of a musical tone to be produced in response to a player's finger touch on a key in order for a player to express his feeling in the reproduced musical tone. Further, it is desirable to control the musical tone in response to a player's finger touch at the instant of key depression i.e., initial touch and to player's after-touch subsequent to the initial touch. The invention especially relates to an improvement of the after-touch control of an electronic musical instrument.

In FIG. 1 showing schematically a construction of a conventional electronic musical instrument with a touch-control function, the tone signal corresponding to a depressed key 1 is produced by a tone generator 2 which may be a voltage-controlled oscillator and then fed through a tone coloring circuit or voltage-controlled filter 3, volume control circuit or voltage-controlled amplifier 4, expression controller 5 and output amplifier 6 to a loudspeaker 7 to sound a musical tone. A touch sensor 8 is provided under the key 1 for producing an after-touch signal corresponding to the depth of subsequent key depression or the pressure subsequently applied to the key 1 which is in turn applied to the volume control circuit 4 to control the volume of the musical tone to be subsequently reproduced in accordance with the player's finger touch on the key. Additionally, the tone color of the musical tone may be controlled in accordance with the player's finger touch on a key as shown by a dashed line. Though not shown, the pitch of the musical tone may also be controlled in the tone generator 2 in accordance with the player's finger touch on a key.

Player's controllability for application of key depressing pressure is different from that for removal of key depressing pressure, the former being more sensitive than the latter. Therefore, when the player releases the depressed key, the touch signal is liable to fall very rapidly without such intention of the player. Further, as in the case of a polyphonic music synthesizer capable of producing a plurality of musical tones corresponding to depressed keys simultaneously, when plural keys are depressed simultaneously and then one key among the already depressed keys is depressed strongly, the pressure applied to the other keys becomes abruptly weak and inevitably due to the characteristic of controllability for finger work, the waveform of touch signals for these keys is caused to vary as shown by a dashed line in FIG. 2. This unintentional rapid descent of the touch signal results in an unnatural musical tone.

An electronic organ system, such as a polyphonic music synthesizer with either a digital musical tone generation system or analog musical tone generation system, capable of determining channels of musical tones to be produced by digital information processing by time-division multiplexing has been recently developed. An example of such an organ system with an analog musical tone generation system is disclosed in the specification of U.S. Pat. No. 4,018,125. With such an organ system, it is desirable that a touch sensor output be processed in a digital fashion. To this end, an analog touch signal as designated by reference numeral 9 in FIG. 1 is analog-to-digital converted. In the case of an digital musical tone generation system, the analog-to-digital converted tough signal is utilized directly as a musical tone control signal. In case of the analog musical tone generation system, on the other hand, the analog-to-digital converted touch signal is digital-to-analog converted and then the thus produced analog touch signal is utilized to control a musical tone to be produced. In such systems as described above, the control waveform signal during the after-touch period of time is also liable to vary as shown by the dashed line in FIG. 2.

SUMMARY OF THE INVENTION

It is an object of this invention to provide an improved digital touch response circuit for use in an electronic musical instrument.

It is another object of this invention to provide a touch response circuit for forming a musical-tone-controlling touch signal by digitally processing a player's finger touch output from a touch sensor in different manners with respect to a key depressing pressure increasing time (crescendo) and a key depressing pressure decreasing time (diminuendo).

According to this invention there is provided a digital touch signal processing circuit comprising temporary memory circuit means having inputs and outputs, storing temporarily therein input information applied to the inputs and sending the input information to the outputs as output information which is utilized to control a musical tone to be produced; operation circuit means having inputs coupled to the outputs of the temporary memory circuit means for producing output information varying at a rate with time; comparison means for effecting comparison between the output information of the operation circuit means and touch sensor output information; and selection means responsive to the comparison means for selectively coupling the output information of the operation circuit means and the touch sensor output information to the inputs of the temporary memory circuit means.

DETAILED DESCRIPTION OF THE PREFERRED EMBODIMENT

Figure 1:
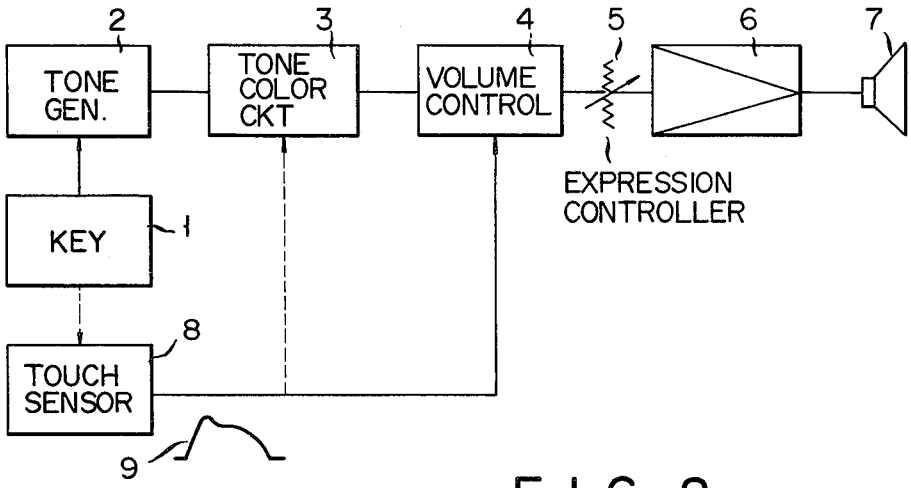
FIG. 1 PRIOR ART
FIG. 1 is a schematic block diagram of a prior art electronic musical instrument having a player's finger touch control function.

A basic construction of a digital touch signal processing circuit according to this invention will be described with reference to FIG. 3. Reference numeral 8 designates a touch sensor the same as that of FIG. 1 which converts a player's finger touch on a key to an electrical signal. The touch sensor may be constructed of a photoconductive cell such as a CdS element arranged such that an amount of light irradiated thereto varies depending on the depth of key depression or a pressure-voltage conversion element which detects the pressure applied to the key. A preferred construction of the touch sensor is disclosed in the specification of the copending U.S. Pat. application No. 762,558 filed Jan. 25, 1977 assigned to the same assignee as this application, now U.S. Pat. No. 4,079,651.

An analog touch signal produced by the touch sensor 8 is converted to digital signals each having plural bits by an analog-to-digital converter 10 in a conventional manner. The bit outputs of analog-to-digital converter 10 are coupled to inputs of a comparator 11 and selector 12. Outputs of the selector are coupled to inputs of a temporary memory 13 which may be constructed of shift registers, for storing temporarily therein the output bit information of the selector 12.

The bit outputs of the memory 13 are applied to inputs of an operation circuit 14 where a certain digital value $\alpha$ having a relatively small value is subtracted from the output data of memory 13 with the result that the output data of the operation circuit 14 decreases with time and at a rate dependent on the rate information $\alpha$. The output data of operation circuit 14 is applied to the comparison circuit 11 and selection circuit 12. The comparison circuit 11 effects a comparison between the output data E of operation circuit 14 and the output data A of analog-to-digital converter 10 to cause, in response to a comparison binary output X i.e., "1" or "0", the selection circuit 12 to selectively couple a larger one of the data A and E to the memory circuit 13.

Figure 2:
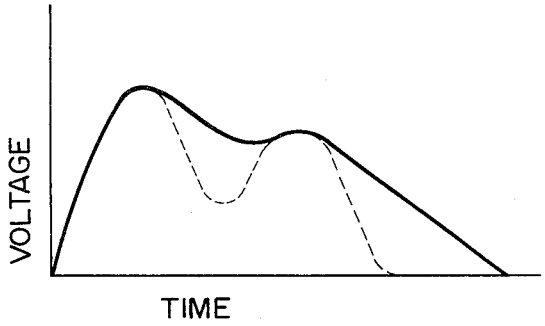
FIG. 2 is a graphic diagram showing an actual waveshape of the touch signal following a player's finger touch on a key which is depicted by a dashed line and a waveshape of the touch signal produced by a touch signal processing circuit of the invention which is depicted by a solid line.
Figure 3:
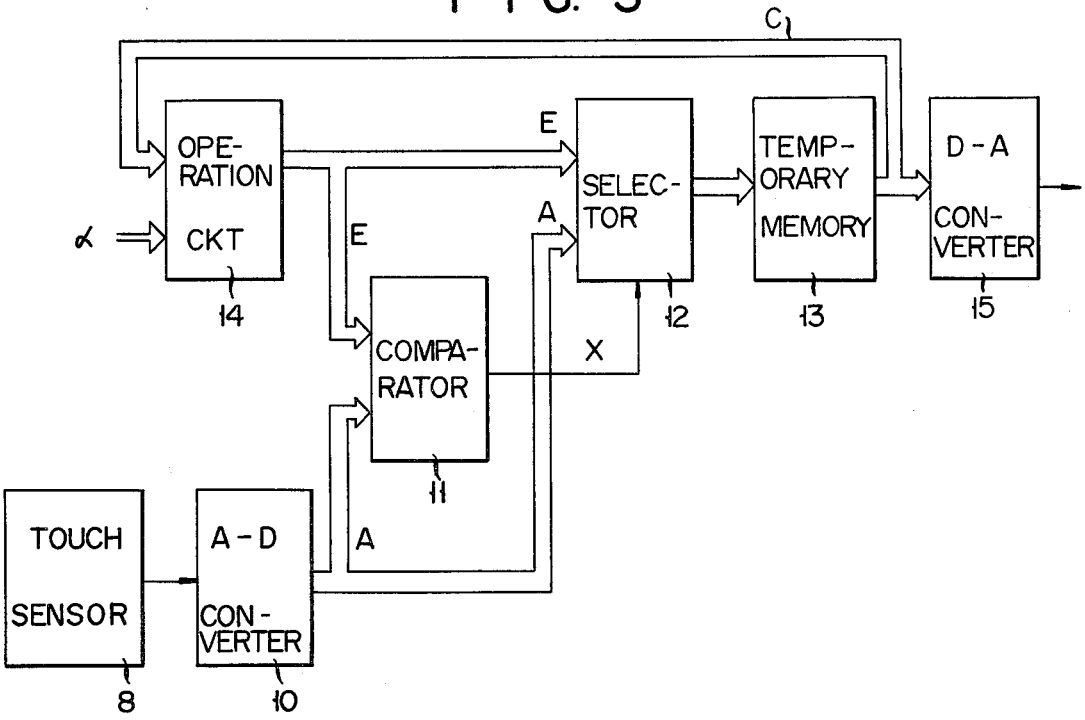
FIG. 3 is a schematic block diagram of a digital touch signal processing circuit according to this invention.

In operation of the touch signal processing circuit of FIG. 3, when a player depresses a key the touch sensor output rises abruptly to an attack level depending on the pressure applied to the key as shown by the waveform of FIG. 2. At this attack time, since the output A of analog-to-digital converter 10 is increasing and greater than the output E of operation circuit 14 the touch sensor output data A is sequentially applied through the selection circuit 12 to the memory 13 and stored therein. Accordingly, the output of memory 13 also increases with time. The output data read out of the memory 13 is fed to the operation circuit 14 to effect subtraction of the constant value $\alpha$ from the output value of memory 13. After the attack time the output level of touch sensor 8 decreases with time. The output of operation circuit 14 decays at the rate determined by the rate information $\alpha$ from an attack value corresponding to the attack level of sensor output. When the after-touch output decays rapidly as shown by the dashed line of FIG. 2 due to rapid reduction in the pressure applied to the key, the data E of operation circuit 14 becomes greater than the data A of the converter 10. As a result, the output X of comparator 11 causes the output E of operation circuit 14 to be fed to the memory 13 through the selection circuit 12. The output of memory 13, therefore, decays at the constant rate defined by the rate information $\alpha$. That is, when the after-touch output decays rapidly at a rate greater than the constant decay rate $\alpha$, the output information of memory 13 does not follow the sensor output but decays at the constant rate $\alpha$. Thereafter, where the pressure applied to the key is increased and thus the touch sensor information A exceeds the output E of operation circuit 14, then the touch sensor output A is sent to the memory 13, whereby the memory output comes to follow the touch sensor output. Further thereafter, when the pressure applied on the key is decreased the memory output is decreased at the rate $\alpha$ as described above even after the key has been released. It will be evident that the digital output of memory 13 varies in accordance with the control waveform as shown by a solid line in FIG. 2 due to the above mentioned operations. For an analog musical tone generation system, the memory output is converted by a digital-to-analog converter 15 to an analog signal having a waveshape as shown by the solid line in FIG. 2.

Figure 4:
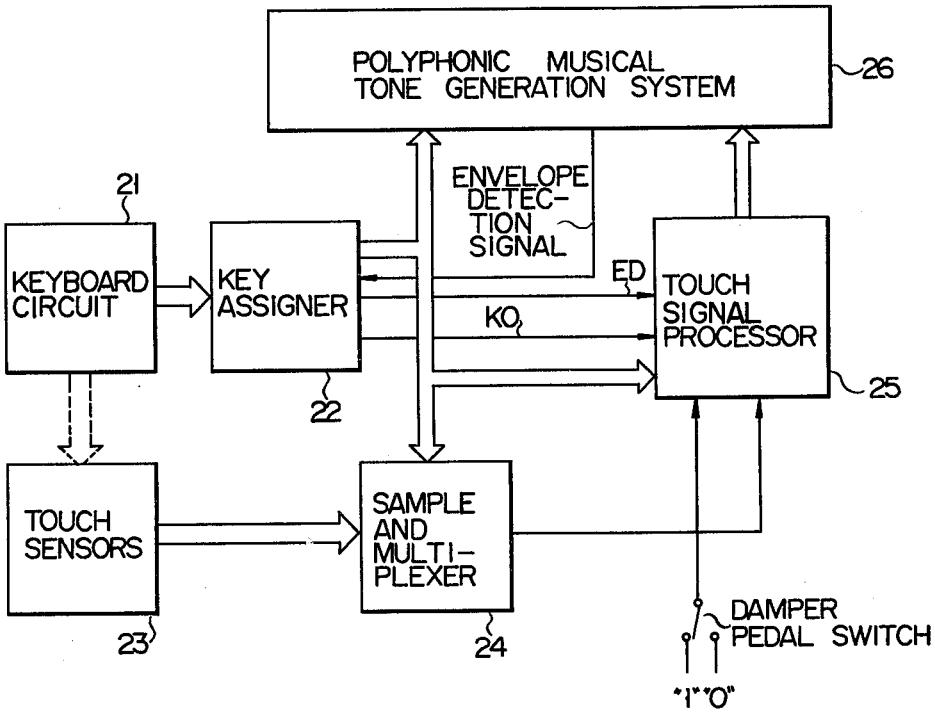
FIG. 4 is a schematic block diagram of a polyphonic musical instrument including a digital touch signal processing circuit.

Having described the touch signal processing circuit for one key, the digital touch signal processing circuit of this invention is suitable for use in an electronic musical instrument using time-division multiplexing system capable of producing plural musical tones simultaneously since the touch signal processing circuit can be used in common to the respective channels. Although an example of such a musical instrument using time-division multiplexing system is disclosed in the aforesaid U.S. Pat. No. 4,018,125, a polyphonic musical instrument using time-division multiplexing system and having the digital touch signal processing circuit of this invention will be described with reference to FIG. 4.

Reference numeral 21 designates a keyboard circuit having key switches to be actuated by respective keys. A key assigner 22 is arranged to detect the ON-OFF states of the respective keys and to produce control signals representing the notes of keys being depressed simultaneously in time shared sequence, serving as channel gate control signals, key gate control signals and key code signals. The maximum number of these signals is the same as that of musical tones to be produced simultaneously. Where a keyboard has 61 keys the key code signals each consist of binary data of 7 bits (4 bits for notes and 3 bits for octaves). A touch sensor portion 23 comprises the same number of touch sensors as the keys. A time-division multiplexer 24 samples and multiplexes parallel touch sensor outputs corresponding to musical tones to be produced simultaneously in time sharing with a timing of the control signals (key gate control signals) from the key assigner 22. Time shared multiplexed touch signals are processed by a digital touch signal processing circuit 25 as will be described later and then supplied to a polyphonic musical tone generation system 26 to control the respective musical tones to be produced. The musical tone generation system may be of either a digital synthesizing type or an analog synthesizing type. With the analog musical tone synthesizing system as described in the specification of the aforesaid U.S. Pat. No. 4,018,125, plural musical tone generation systems including voltage-controlled oscillators produce musical tones corresponding to the keys being depressed in response to note voltages sampled in a time sharing manner by the control signals (key gate control signals) from the key assigner. The time shared multiplexed digital touch signals are distributed to respective digital-to-analog converters for the respective channels in time sharing manner by control signals (channel gate control signals) from the key assigner 22. Analog converted touch signals are utilized to control the musical tones to be produced. In case of the digital musical tone synthesizing system, time shared multiplexed key code signals are also used in generation of musical tones.

A preferred embodiment of the digital touch signal processing circuit according to this invention will be described with reference to FIG. 5. The same parts of FIG. 5 as those of FIG. 3 are designated by like numerals. The analog-to-digital converter 10 converts the sampled and multiplexed analog touch signals from the multiplexer 24 to digital signals each consisting of n-bit binary data. To broaden the dynamic range of the analog-to-digital converter 10 the touch sensor outputs may be subjected to logarithmic conversion. In the present embodiment it is assumed that all the bits of the binary data corresponding to the possible maximum output of touch sensor are "0" and all the bits of the binary data corresponding to the minimum touch sensor output are "1". This assumption is made taking into consideration utilization circuits or digital-to-analog converters connected to the output side of the memory circuit 13.

The comparator 11 compares the n-bit binary data A ($a_1$, $a_2$, . . . $a_n$) from the converter 10 with the n-bit binary data E ($e_1$, $e_2$, . . . $e_n$) from the operation circuit 14 and renders the output X thereof at a "1" level when $A<E$ and at a "0" level when $A>E$.

The selection circuit 12 is provided with n pairs of two input AND gates $Ae_1$, $Aa_1$; $Ae_2$, $Aa_2$; . . . $Ae_n$, $Aa_n$. To the first inputs of AND gates $Aa_1$ to $Aa_n$ are coupled the outputs $a_1$ to $a_n$ of the analog-to-digital converter 10, respectively. The output X of comparator 11 is coupled to the second inputs of AND gates $Aa_1$ to $Aa_n$. The outputs $e_1$ to $e_n$ of operation circuit 14 are respectively coupled to the first inputs of AND gates $Ae_1$ to $Ae_n$. To the second inputs of AND gates $Ae_1$ to $Ae_n$ is coupled the output of an inverter 30 whose input is coupled to the output of comparator 11. Accordingly, when $E>A$, the selection circuit 12 couples the touch sensor binary data A ($a_1$, $a_2$, . . . $a_n$) to the temporary memory circuit 13 through OR gates $O_1$ to $O_n$ since AND gates $Aa_1$ to $Aa_n$ are enabled and AND gates $Ae_1$ to $Ae_n$ are disabled. When $E<A$, on the other hand, the selection circuit 12 feeds the binary data E ($e_1$ to $e_n$) from the operation circuit 14 to the memory circuit 13 since the AND gates $Ae_1$ to $Ae_n$ are enabled and AND gates $Aa_1$ to $Aa_n$ are disabled.

The temporary memory circuit 13 is constructed by n shift registers 13-1 to 13-n each consisting of m bit stages if the number of channels is m, in other words, the maximum number of musical tones to be produced simultaneously is m. The data shift operation in the shift registers 13-1 to 13-n is performed in synchronism with a timing of time-division in the multiplexer 24. More specifically stated, m data words each consisting of n bits in the shift registers 13-1 to 13-n are shifted sequentially in synchronism with control signals (channel gate control signals or channel clock signals). The output data bits $C_1$ and $C_n$ of the memory 13 represent the least significant bit and most significant bit of each data word, respectively. Output data words are sequentially applied to the operation circuit 14.

The operation circuit 14 is, in the present embodiment, constructed by n-bit parallel adder arranged such that the carry output of each one-bit adder except for the highest order one supplied with the most significant input bit $C_n$ is coupled to an input of the next higher order-adder. In the adder 14, rate information $\alpha$ defining the decay rate of a control waveform as described above and stored in a rate information generator or read only memory (ROM) 31 is added to the input data C. The number of bits of the rate information may be less than the bit number of each data word. In the drawing, the rate information $\alpha$ consists of l bits $\alpha_1$, $\alpha_2$ . . . $\alpha_l$ which are respectively added to the input data bits $C_1$, $C_2$ . . . $C_l$ where l is smaller than n. The time-shared multiplexed key code signals from the key assigner may be coupled to the ROM 31 to alter rate information read out of the ROM in accordance with the notes of keys being depressed. As a result, the decay rate of a control waveform can be set in accordance with the note of a key being depressed. It is desirable that the value of data $\alpha$ read out of the ROM 31 increase with increase in the pitch of a musical tone to be produced. However, it is not necessarily required that different decay rates be set for the respective keys. It may be arranged, for example, that the same rate information is read out of the ROM 31 for the key notes in an octave range. It will be evident that, when the output data of the adder 14 circulates through the selection circuit 12, memory 13 and adder 14, the output data will increase at a rate defined by the rate information $\alpha$ from the all bit "0" state to the all bit "1" state.

A damper pedal actuated switch SW may be coupled to the ROM 31 as shown to make small the rate value $\alpha$ to be read out of ROM, that is, to decrease the decay rate of control waveform when the damper pedal (not shown) is depressed. To this end, the ROM may be arranged to store two different rate values for each key, read out a larger value when the damper pedal is not depressed, and a smaller value when the damper pedal is depressed.

OR gates $O_{11}$ to $O_{1n}$ are connected between the adder 14 and selection circuit 12. The outputs of adder 14 are respectively coupled to the first inputs of OR gates $O_{11}$ to $O_{1n}$ and the carry output of the highest order-adder in the parallel adder 14 is coupled to the second inputs of OR gates $O_{11}$ to $O_{1n}$. These OR gates are intended to prevent the output data of adder circuit 14 to be fed to the selection circuit 12 from becoming close to the all bit "0" state (representing the maximum level of a touch signal) as the result of addition of the rate value $\alpha$ to the all "1" input bits (representing the minimum level of touch signal) applied to the adder 14. Namely, due to the carry output applied to the OR gates $O_{11}$ to $O_{1n}$ from the adder 14 all the bits $e_1$ to $e_n$ are held at "1".

Time-shared multiplexed key-ON signals (control waveform gate control signals) representing depression of keys are coupled to an input of AND gate 32 to the other input of which is coupled the output X of the comparator 11. The AND gate 32 is enabled by the key-ON signal. Accordingly, when no key-ON signal exists the AND gates $Aa_1$ to $Aa_n$ in the selection circuit 12 are disabled and, on the other hand, the AND gates $Ae_1$ to $Ae_n$ are enabled by a "1" output of the inverter 30. As a result, data words in the memory 13 circulate through the adder 14, selection circuit 12 and memory 13 to form a sustain envelope of a tone signal after releasing the key.

Figure 6:
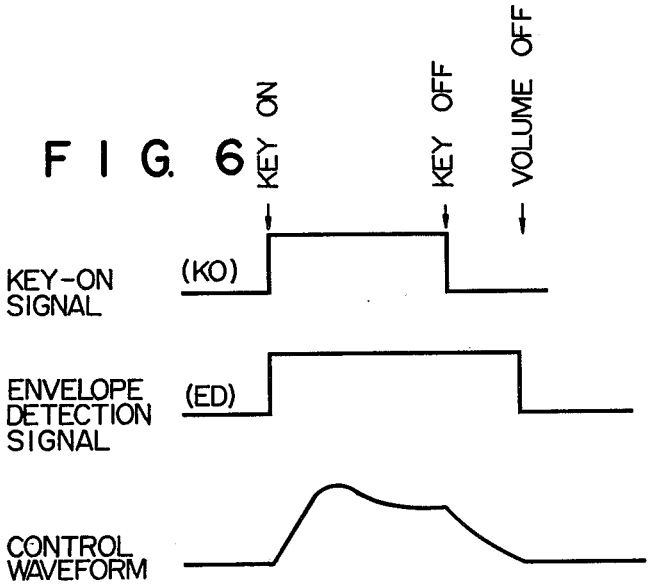
FIG. 6 shows waveshapes of a key-ON signal, musical tone volume detection signal, and output touch signal.

Between the selection circuit 12 and the memory circuit 13 are connected OR gates $O_{21}$ to $O_{2n}$ to the first inputs of which are coupled through an inverter 33 the inverse of time-shared multiplexed volume or envelope detection signals each continuing from a key depression time until when the volume of a musical tone being produced becomes zero. To the second inputs of OR gates $O_{21}$ to $O_{2n}$ are respectively coupled the outputs of OR gates $O_1$ to $O_n$ in the selection circuit 12. The envelope detection signals may be produced by detecting the volumes of musical tones being produced in the respective channels in a time sharing manner by the control signals (channel gate control signals). When generation of a musical tone in a channel is stopped the OR gates $O_{21}$ to $O_{2n}$ make at "1" all the bits of a data word corresponding to the said channel which is to be stored in the memory 13 since the output of inverter 33 is made at "1". FIG. 6 shows a relationship between a key-ON signal KO, envelope detection signal ED and control waveform which is produced by the data words from the memory 13.

Figure 5:
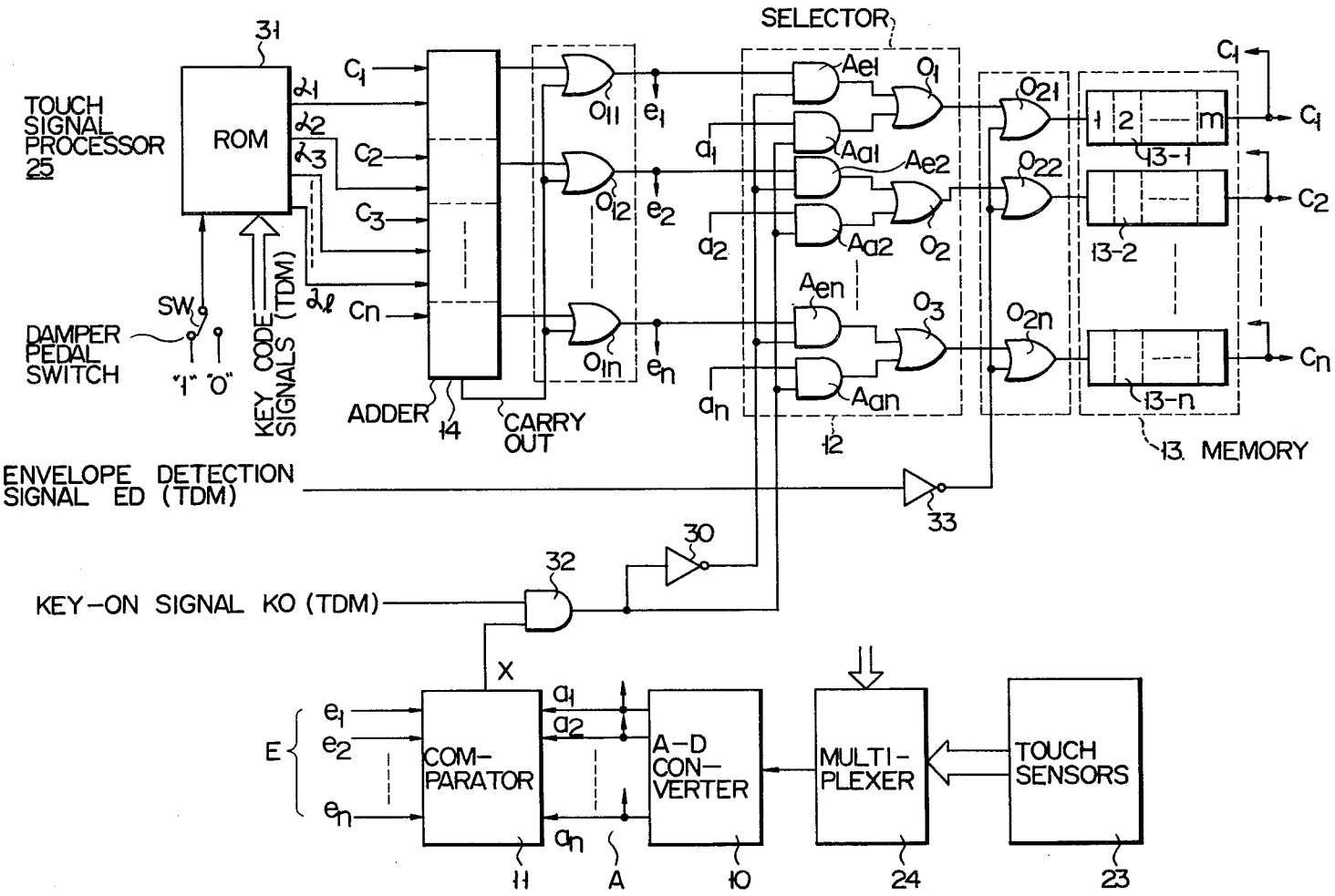
FIG. 5 shows an example of construction of the digital touch signal processing circuit of FIG. 4.

In the embodiment of FIG. 5 the adder is used as the operation circuit, but a subtractor, multiplier, or divider may be used instead. As the touch sensor, use is also made of a type capable of directly producing a digital touch signal with the result that the analog-to-digital converter can be omitted. The touch response circuit as described above may be applied to either a monophonic musical tone generation system or a polyphonic musical tone generation system.

What is claimed is:

1. In an electronic musical instrument having touch sensor means producing touch information varying with time in accordance with a player's finger touch on a key, a digital touch signal processing circuit comprising:

temporary memory means, having inputs and outputs, for storing temporarily therein input information applied to the inputs and sending the input information to the outputs as output information which is utilized to control a musical tone to be produced;

arithemetic operation means having inputs coupled to the outputs of said temporary memory means for arithmetically operating on the output information of the temporary memory means to produce output information having a difference in value from said output information of the temporary memory means;

comparison means for effecting comparison between the output information of said arithmetic operation means and said touch sensor means; and selection circuit means coupled to receive the outputs of said arithmetic operation means and said touch sensor means and being responsive to the output of said comparison means for selectively coupling the output information of said arithmetic operation means and said touch sensor means to the inputs of said temporary memory means;

the outputs of said temporary memory means being coupled to control the musical tone to be produced.

2. A digital touch signal processing circuit according to claim 1, in which the output information of said touch sensor means is analog information, and further comprising analog-to-digital converting means coupled to said touch sensor means for producing digital touch sensor output information to be coupled to said comparison means and selection means.

3. A digital touch signal processing circuit according to claim 1 further comprising means for changing the difference by which the output information of said arithmetic operation means differs from the output information of said temporary memory means.

4. A digital touch signal processing circuit according to claim 1 further comprising difference information generation means for applying difference information to said arithmetic operation means to determine the difference between the output information of said arithmetic operation means and said temporary memory means, said difference information generation means being arranged to vary, in response to application thereto of information of a key being depressed, the difference information applied to said arithmetic operation means.

5. A digital touch signal processing circuit according to claim 1, in which said selection circuit means is arranged to couple, in response to application thereto of a control signal representing key-OFF, the output information of said arithmetic operation circuit means to said temporary memory means.

6. A digital touch signal processing circuit according to claim 1 further comprising means coupled between said selection circuit means and said temporary memory means and responsive to a control signal representing that the production of a musical tone has been stopped to stop the application of information from said selection circuit means to said temporary memory means.

7. In an electronic musical instrument having touch sensor means producing touch information varying with time in accordance with a player's finger touch on a key, a digital touch signal processing circuit comprising:

temporary memory means having inputs and outputs, for storing temporarily therein input information applied to the inputs and sending the input information to the outputs as output information which is utilized to control a musical tone to be produced;

arithmetic operation means having inputs coupled to the outputs of said temporary memory circuit means for arithmetically operating on the output information of said temporary memory means to produce output information smaller in value than the output information of said temporary memory means;

comparison means for effecting comparison between the output information of said arithmetic operation means and said touch sensor means; and selection circuit means coupled to receive the output information of said arithmetic operation means and said touch sensor means and being responsive to said comparison means for coupling the output information of said touch sensor means to the inputs of said temporary memory means when it is larger in value than the output information of said arithmetic operation means and for coupling the output information of said arithmetic operation means to the inputs of said temporary memory means when it is larger in value than the output information of said touch sensor means.

8. A digital touch signal processing circuit according to claim 7, in which the output information of said touch sensor means is analog information, and further comprising analog-to-digital converting means coupling to said touch sensor means for producing digital touch sensor output information to be coupled to said comparison means and selection means.

9. A digital touch signal processing circuit according to claim 7 further comprising means for changing the difference by which the output information of said arithmetic operation means differs from the output information of said temporary memory means.

10. A digital touch signal processing circuit according to claim 7 further comprising difference information generation means for applying difference information to said arithmetic operation means to determine the difference between the output information of said arithmetic operation means and said temporary memory means, said difference information generation means being arranged to vary, in response to application thereto of information of a key being depressed, the difference information applied to said arithmetic operation means.

11. A digital touch signal processing circuit according to claim 7, in which said selection circuit means is arranged to couple, in response to application thereto of a control signal representing Key-OFF, the output information of said arithmetic operation means to said temporary memory means.

12. A digital touch signal processing circuit according to claim 7 further comprising means coupled between said selection circuit means and said temporary memory means and responsive to a control signal representing that the production of a musical tone has been stopped to stop the application of information from said selection circuit means to said temporary memory means.

* * * * *